US006993807B2

(12) United States Patent
Courtney

(10) Patent No.: US 6,993,807 B2
(45) Date of Patent: Feb. 7, 2006

(54) FLOOR CLEANING APPARATUS INCLUDING DISPENSER FOR DISPENSING PARTICULATE CLEANING MATERIAL

(75) Inventor: Stephen Benjamin Courtney, Bath (GB)

(73) Assignee: Dyson Technology Limited, Wiltshire (GB)

( * ) Notice: Subject to any disclaimer, the term of this patent is extended or adjusted under 35 U.S.C. 154(b) by 317 days.

(21) Appl. No.: 10/275,471

(22) PCT Filed: Apr. 25, 2001

(86) PCT No.: PCT/GB01/01833

§ 371 (c)(1),
(2), (4) Date: Nov. 6, 2002

(87) PCT Pub. No.: WO01/85005

PCT Pub. Date: Nov. 15, 2001

(65) Prior Publication Data

US 2003/0177601 A1 Sep. 25, 2003

(30) Foreign Application Priority Data

May 6, 2000 (GB) ..... 0010917

(51) Int. Cl.
*A47L 11/03* (2006.01)

(52) U.S. Cl. ..... 15/320; 15/328; 15/246.2; 222/287; 222/517; 222/619

(58) Field of Classification Search ..... 15/320, 15/246.2, 328; 222/608, 619, 564, 517, 287, 222/514

See application file for complete search history.

(56) References Cited

U.S. PATENT DOCUMENTS

| | | | | |
|---|---|---|---|---|
| 2,733,839 A | * | 2/1956 | Blum | 222/517 |
| 3,365,103 A | * | 1/1968 | Van Der Lely | 222/608 |
| 4,268,935 A | | 5/1981 | Bessinger | |
| 5,101,532 A | | 4/1992 | Dyson et al. | |
| 5,427,283 A | * | 6/1995 | Whittaker et al. | 222/414 |

FOREIGN PATENT DOCUMENTS

| | | |
|---|---|---|
| DE | 27 03 819 A1 | 8/1978 |
| EP | 0 157 923 A1 | 10/1985 |
| EP | 0 182 230 A1 | 5/1986 |

* cited by examiner

*Primary Examiner*—Theresa T. Snider
(74) *Attorney, Agent, or Firm*—Morrison & Foerster LLP

(57) ABSTRACT

A dispenser for dispensing particulate cleaning material onto a floor surface includes a hopper holding the particulate material and a dispensing aperture extending across the hopper through which the material may be dispensed. A separator, which may for example be a wire, is located adjacent the dispensing aperture for separating the particulate cleaning material at the aperture. The wire helps to break up clumps of particulate cleaning material which may form. In use, a plate is vibrated to impart motion to the particulate material in the hopper. The wire can be carried by the plate or by the hopper and is preferably held under tension.

13 Claims, 6 Drawing Sheets

FLOOR CLEANING APPARATUS INCLUDING DISPENSER FOR DISPENSING PARTICULATE CLEANING MATERIAL

FIELD OF THE INVENTION

This invention relates to a dispenser for dispensing particulate cleaning material onto a floor surface and to floor cleaning apparatus incorporating such a dispenser.

BACKGROUND OF THE INVENTION

Floor coverings such as carpets and rugs are prone to marks and stains. Floor coverings can be cleaned in a number of ways, which can be classified as 'wet' or 'dry' cleaning methods. Wet cleaning methods such as washing or shampooing the floor covering have the disadvantage that they can cause shrinkage of the floor covering. Dry cleaning generally involves depositing a powdered composition onto the floor covering which can readily absorb soil and contaminants from the floor covering. The powder is worked into the floor covering with the aid of a brush. Finally the dirty powder can then be removed from the floor covering by a vacuum cleaner. While such compositions are called 'dry', in that they flow as a powder at room temperature, they usually contain a quantity of liquid such as water or organic solvents.

The cleaning powder needs to be dispensed on to the floor covering. U.S. Pat. No. 4,268,935 and U.S. Pat. No. 5,101,532 describe powder-dispensing machines for use in cleaning carpets. In U.S. Pat. No. 5,101,532, the machine has a hopper on the front of the machine for storing dry-cleaning powder. At the front, lower part of the hopper there is a jaw which is formed by a lower flap which is hingedly fixed to the hopper. In use, the flap is oscillated about a mean gap width of around 4 mm so as to dispense powder onto the floor surface. The position of the lower flap is controlled by a user-operated control which moves the flap between one of two fixed positions: a dispense position, in which the flap is set to the 4 mm gap, and a grooming and vacuuming position in which the flap seals the hopper to prevent any powder escaping from the hopper. In use, the machine dispenses powder onto the floor surface at a controlled rate. It has been found that the powdered material can sometimes be dispensed unevenly. Since the powder is moist rather than truly 'dry', it can form into lumps. Such lumps will either be dispensed on to the floor covering or will jam in the jaw of the dispenser, thus preventing any powder from being dispensed from that part of the dispenser. This leads to dissatisfaction for a user of the machine.

SUMMARY OF THE INVENTION

The present invention seeks to provide a floor cleaning apparatus which dispenses particulate material more evenly on to a floor surface.

Accordingly, the present invention provides a dispenser for dispensing particulate cleaning material onto a floor surface comprising a hopper for holding the particulate material, a dispensing aperture extending across the hopper through which the particulate material can be dispensed and separating means adjacent the dispensing aperture for separating the particulate material before it is dispensed through the aperture by performing a cutting action on the particulate material.

The provision of separating means helps to break up and to clear any clumps of particulate material which may form, thus ensuring that particulate material is dispensed evenly through the dispensing aperture.

The term 'floor surface' is intended to cover any type of floor covering such as carpet or a rug which may be present on the actual surface of the floor.

Preferably a part of the hopper is movable with respect to the hopper to impart movement to particulate material in the hopper and the dispensing aperture is a gap between the movable part and the hopper. More preferably, the separating means is carried by the movable part, which has the advantage that the separating means is also moved during use of the dispenser to provide an improved separating action on material at the aperture. It is preferred that the separating means are attached to the sides of the movable part. This has the advantage that use can be made of the full width of the slot for dispensing particulate material.

Alternatively, the separating means can be carried by the hopper.

Preferably the separating means is spaced from the surface of the hopper which carries the particulate material. This allows smaller particulate material to flow beneath the separating means while also providing an effective separating effect on larger particulate material.

The separating means can tale various forms. A preferable form of separating means is a wire. A wire has been found to provide a particularly effective separating or cutting action on clumps of cleaning powder at the aperture while also being safe for a user to touch and being easy to clean should this be necessary. The separating efficiency is further improved if the wire is held under tension.

The dispenser can be provided as part of a floor cleaning apparatus, either as an integral part of the apparatus or as a removable attachment to the apparatus.

BRIEF DESCRIPTION OF THE DRAWINGS

Embodiments of the invention will now be described, by way of example only, with reference to the accompanying drawings in which.

DETAILED DESCRIPTION OF THE INVENTION

Figure 1:
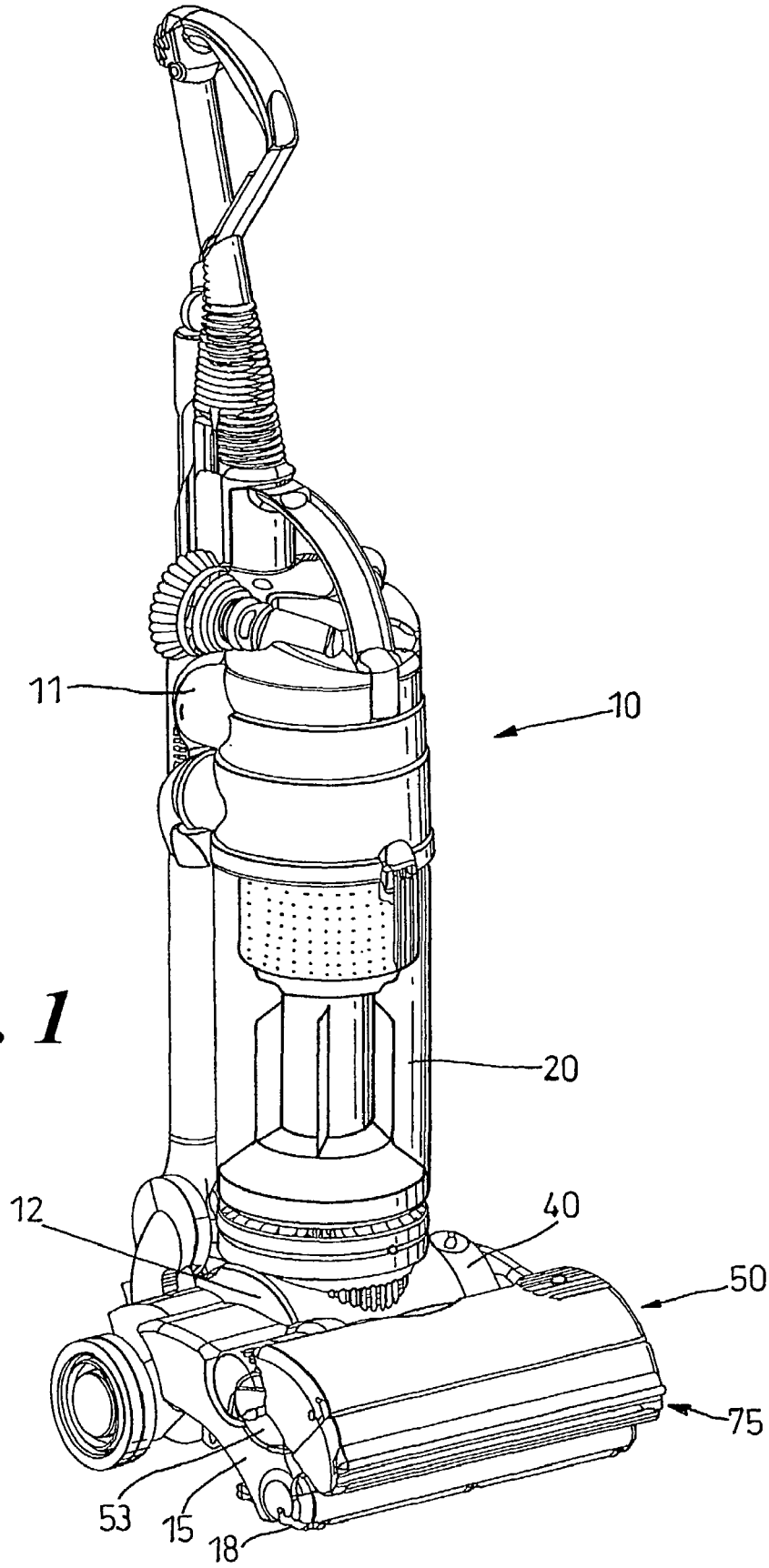
FIG. 1 shows a vacuum cleaner incorporating dispensing apparatus according to an embodiment of the invention.
Figure 2:
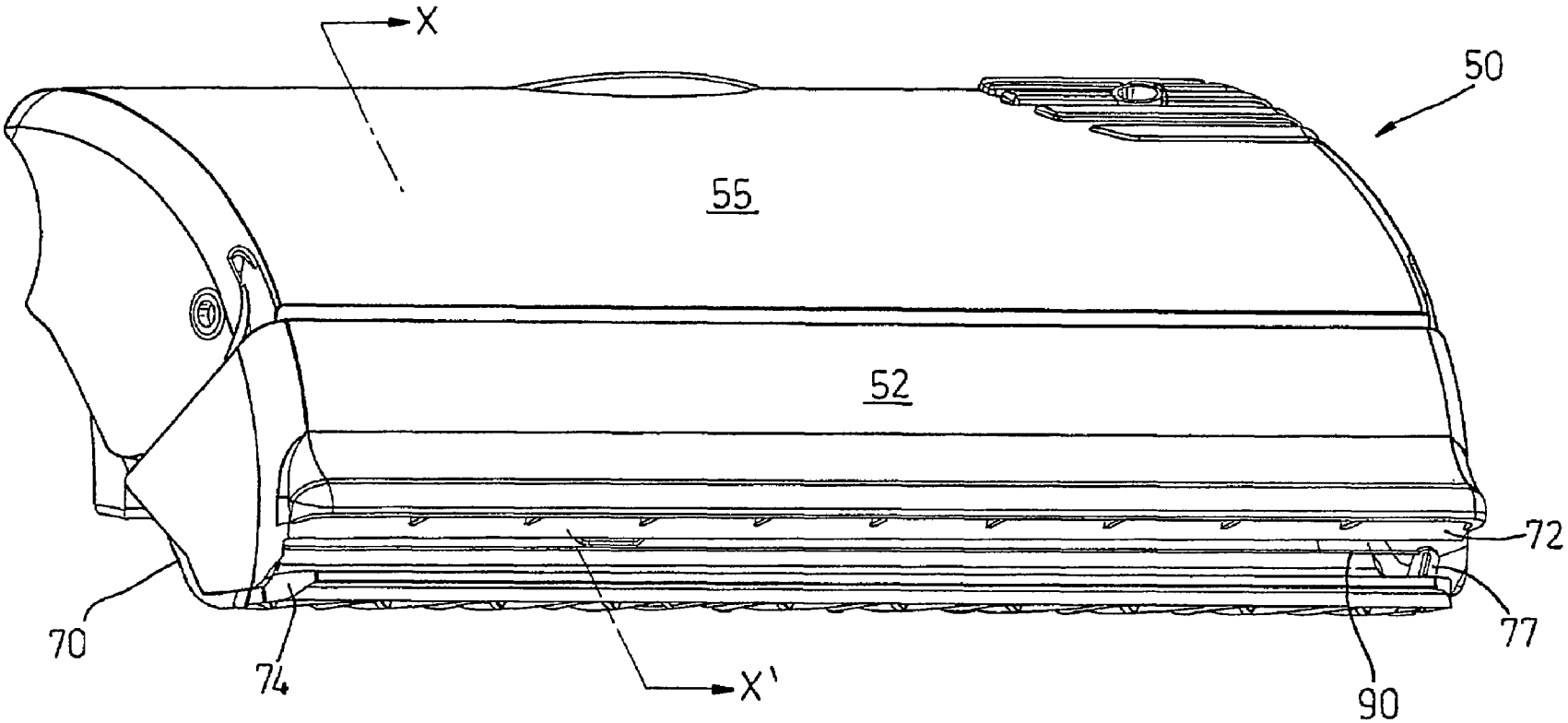
FIG. 2 shows the dispensing apparatus with the dispensing aperture open.

FIG. 1 shows a vacuum cleaner 10 which includes a dispenser 50 for dispensing particulate dry cleaning material onto a floor surface. The vacuum cleaner 10 is largely of a conventional design. The main body 11 has a motor housing 12 at its lower end. A cleaner head 15 is rotatably mounted to the motor housing to allow the cleaner head to remain in contact with the floor surface as the main body 11 is moved rearwardly into a normal operating position for upright cleaning. The cleaning head 15 includes an inlet 18 through which dirty air can be drawn into the cleaner and a brush bar for beating the floor surface. The main body 11 supports separating apparatus 20 which separates dirt and dust from the dirty air. The separating apparatus is preferably cyclonic separation apparatus using two cyclonic separation stages although it can take the form of a bag or other form of separator. Cyclonic separators have been found to be particularly effective at separating the dirty dry cleaning powder from the air drawn in to the cleaner 10. The separating apparatus 20 is removable from the main body 11 to allow the separating apparatus to be emptied.

Figure 3:
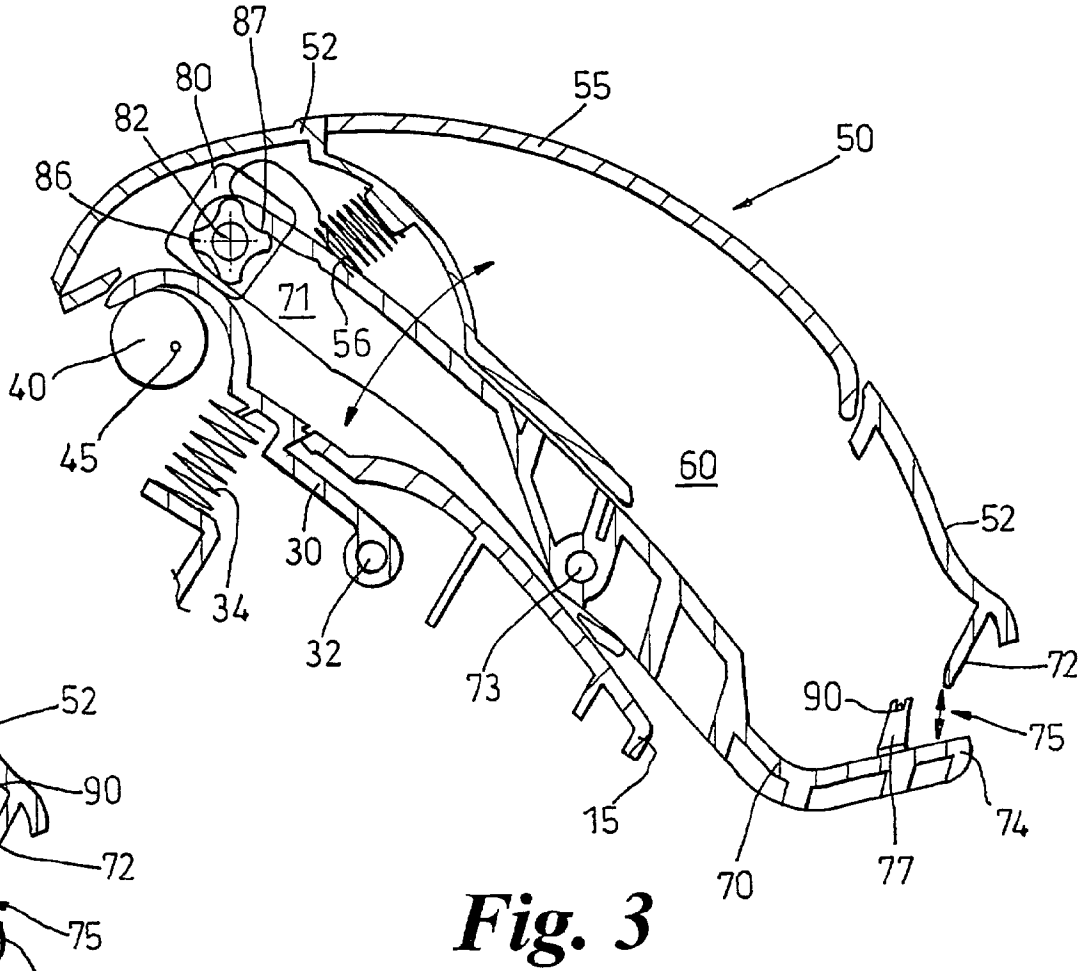
FIG. 3 is a cross-section through the dispensing apparatus of FIG. 2.

The vacuum cleaner 10 is modified with respect to a normal cleaner to support dispenser 50. The dispenser 50 is more clearly shown in FIGS. 2–10. The dispenser 50 fits onto the upper face of the cleaner head 15 and extends transversely across the cleaner head 15, parallel to the floor surface. A lug on each side of the dispenser 50 fits in a slot on each forward corner of the upper face of the cleaner head 15. These slots are shaped to allow the dispenser 50 to pivot from a generally upright position in which the dispenser 50 is inoperable to an operable position in which the dispenser 50 lies flush with the cleaner head 15. The dispenser 50 is shown in the operable position in FIG. 1. In the operable position an arm 53 on each side of the dispenser 50 fits in a recess on the side of the cleaner head 15 and a flange on the rear face of the dispenser 50 is received by a clamp on the cleaner head 15. The clamp is linked to a foot pedal 40 so that when a user presses on the foot pedal 40 the clamp is opened to release the dispenser 50. As shown in FIG. 3, the dispenser 50 comprises a hopper housing 52 whose rear face is defined by a plate 70 which is pivotally mounted to the housing 52 about an axle 73. The forward, upper face of the hopper is defined by a lid 55 which is pivotally mounted to the housing 52, the lid 55 opening from the uppermost end. The chamber 60 defined by the housing 52, plate 70 and lid 55 has a volume which is sufficient to receive a useful quantity of dry-cleaning powder. An arm 71 (best seen in FIG. 7) extends from the plate 70.

The cleaner head 15 includes a cam 40 for moving the arm 71 of the hopper plate 70 of the dispenser 50. The cam 40 is driven by way of the main motor (not shown) of the cleaner 10 and a drive shaft 45. The cam 40 is mounted inside the cleaner head 15, and a slot extends inwardly from the outer casing of the cleaner head towards the cam 40. A cam guard 30 is mounted within the slot and serves as both a cam follower and a guard. Cam guard 30 is pivotable about axle 32 and is normally biased, by spring 34, into a position in which it lies flush with the outer surface of the cleaner head 15. When the dispenser is mounted on the cleaner head 15, the cam guard 30 is pressed inwardly. against the spring 34, to lie against the cam 40 and can then follow the shape of the cam 40. The guard makes it impossible for a user or a child to trap a finger or an object between the cam and the casing, thus preventing injury to a user and damage to the cleaner.

The lower parts of the hopper plate 70 and housing 52 form a jaw which defines a dispensing aperture 75. The aperture is defined by a flange 72, which extends outwardly from the lower, forward part of housing 52, and end 74 of hopper plate 70. Plate 70 is driven by the cam 40 in the cleaner head 15, motion of the cam being transmitted to the plate 70 via the cam guard 30 and adjustment wheel 80. Motion of the plate 70 is constrained by spring 56 which fits between the plate 70 and housing 52. Plate 70 also carries a wire 90. The wire extends across the full width of the plate, parallel with the plate and the floor surface. The purpose of the wire 90 is to separate clumps of powder prior to the powder being dispensed onto the floor surface. Rapid movement of the plate 70, and therefore the wire 90, serves to cut through the powder.

Figure 4:
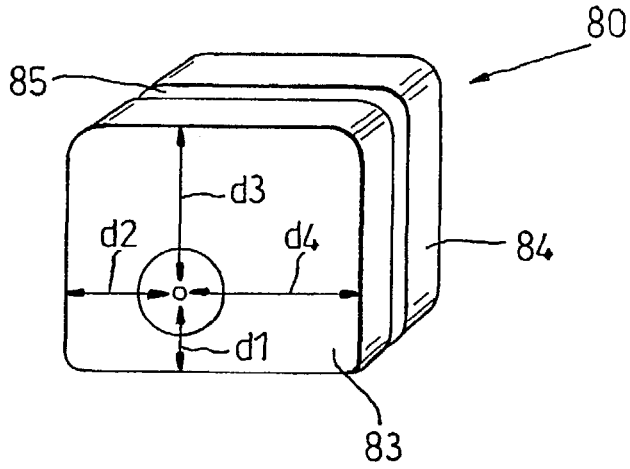
FIG. 4 shows the adjustable part of the dispensing apparatus of FIGS. 2 and 3.

In use, the width of aperture 75 will vary as the plate 70 is driven by the cam 40 in the cleaner head 15. Aperture 75 has a mean width, the width increasing or decreasing a small amount from this mean width as the plate 70 is driven. The mean width of the aperture has an effect on the rate at which powder is dispensed. The mean width of aperture 75 is controlled via adjustment wheel 80. Adjustment wheel 80 fits between the arm 71 and the cam guard 30 and, in addition to performing a cam following function, it controls the distance between these parts, which in turn controls the spacing between part 74 of plate 70 and flange 72, i.e. the width of the aperture 75. The adjustment wheel can be set in one of a number of different positions, each position providing a different distance between the cam guard 30 and plate 70. The adjustment wheel 80 is pivotably mounted about an axle 82 which is supported on arm 71. The wheel 80 has a different radius in different angular directions about the axle and is resiliently held in each of the differently dimensioned positions. FIG. 4 shows the wheel in more detail. The wheel is generally rectangular in shape and comprises two spaced apart members 83, 84 which are separated by a gap 85. The outer surface of the members 83, 84 is used to press against the cam follower of the cleaner head. The wheel 80 is mounted eccentrically about axle 82 to provide four differently dimensioned positions which are labelled in FIG. 4 as d1, d2, d3, d4. Within the gap 85 there is a spider-like part 86 which has the function of retaining the wheel 80 in the differently dimensioned positions. The spider 86 has four grooves around its outer surface which cooperate with a projection 87 carried by arm 71. The wheel can be snapped in to each of the positions by rotating wheel 80 against the resilience of projection 87. Each of the positions of the wheel are labelled, such as by numbering, to aid a user in selecting an appropriate setting for the dispenser. Typically, each setting of the adjustment wheel changes the mean width of aperture 75 by 1 mm.

Figure 5:
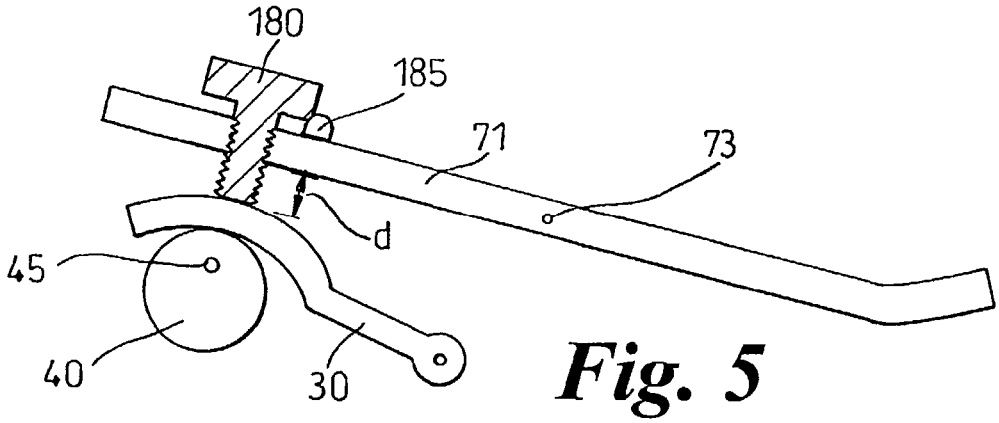
FIGS. 5 and 6 show alternative forms of the adjustable part of the dispensing apparatus of FIGS. 2 and 3.
Figure 6:
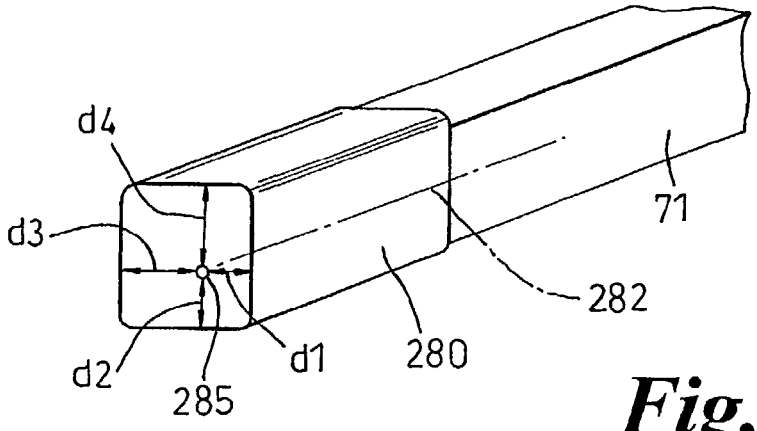

FIGS. 5 & 6 show alternatives to the adjustment wheel 80 which also achieve the same effect of varying the distance between the arm 71 and cam guard 30. In FIG. 5, an adjustment screw 180 is received in a threaded bore through the arm 71 of the hopper plate 70. By turning the screw, the distance d can be varied. In use, the rapid vibration of the arm 71 may cause the screw to rotate, thereby altering the distance d and the width of aperture 75. To prevent this rotation, the screw 180 has a tab 185 which engages with ribs on the upper surface of arm 71. Tab 185 can project radially outwardly from the head of the screw 180, axially between the screw head and the upper surface of the arm 71 or a combination of these, as shown in FIG. 5. In FIG. 6 part 280 of arm 71 represents the end of arm 71 which lies alongside the cam guard 30 of the cleaner head. Part 280 is rotatable with respect to the remainder of the arm 71 about axis 282. As with the adjustment wheel 80, part 280 is mounted eccentrically with respect to axis 282 so that each position of part 280 provides a different distance d1, d2, d3, d4 between the arm and the cam follower 30. In each of these embodiments it will be appreciated that the cam guard 30 could be omitted and the adjustment means itself, whether it is the adjustment wheel 80, adjustment screw 180 or rotatable part 280 directly follows the cam 40.

Figure 9:
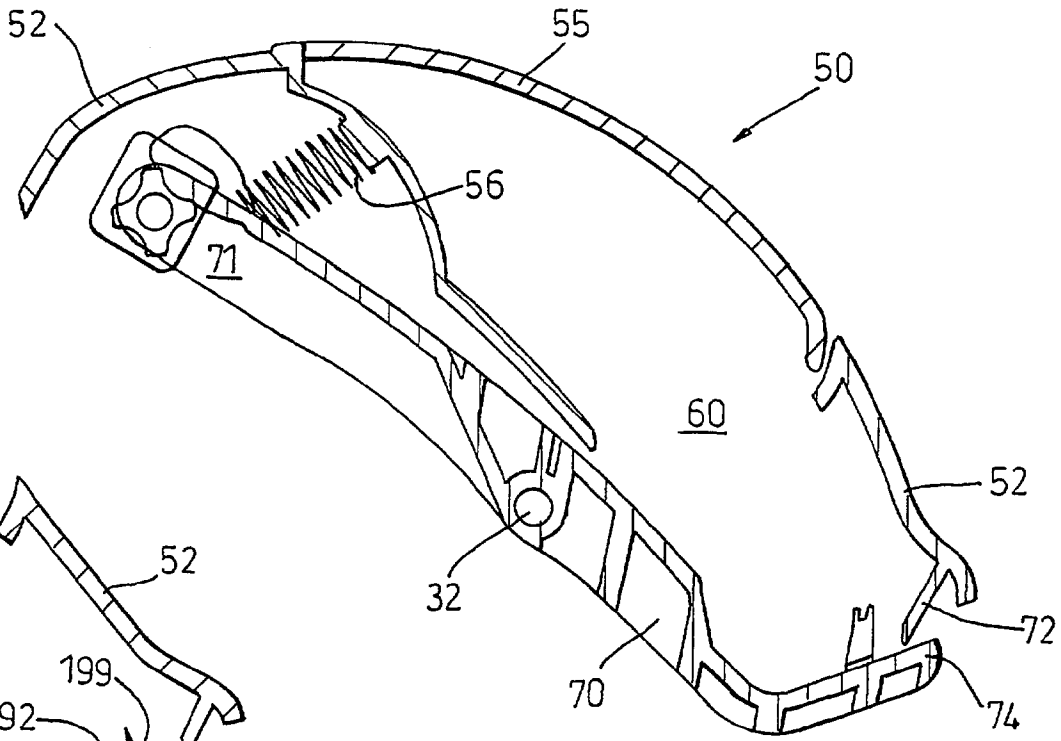
FIG. 9 is a similar cross-section to the one of FIG. 3 but showing the dispensing aperture in a closed position; and, FIG. 10 shows an alternative form of the separating means.

The dispenser 50 has a self-closing action. Spring 56 acts on arm 71 of the hopper plate 70 at all times. When the dispenser 50 is removed from the cleaner head, spring 56 acts on arm 71 so as to maintain plate 70 in a closed position where edge 74 of the plate 70 is sealed against, or rests closely to, the edge of flange 72. This prevents cleaning powder from escaping from the dispenser 50. This closed position is shown in FIG. 9. When the dispenser 50 is fitted to the cleaner head in preparation for use, arm 71 is urged upwards (as viewed in FIG. 3) against the bias of spring 56 which moves edge 74 of plate 70 away from flange 72 of the housing 52, thereby opening the dispensing aperture 75. The position of the wire 90 upstream of the flange 72 allows the plate 70 to properly close, while the wire still provides an effective separating action on powder at the aperture 75. The biasing action of spring 56 could be achieved with an alternative form of resilient device. The biasing action could also be achieved by positioning the spring in a different position to the one shown in FIG. 3. For example, a spring could be coiled around axle 73, the ends of the spring acting on the plate 70 and housing 52, although this alternative position loses the mechanical levering advantage that is gained from the position shown in FIG. 3.

As described above, a wire 90 extends across the dispenser 50 in the region of the dispensing aperture 75. A particularly effective separating action on the cleaning powder has been experienced using a wire having a diameter of 0.6 mm which is spaced from the plate 70 by a distance of 7 mm. However, it will be appreciated that a wire having a different diameter and separated from the plate by a different distance would also provide similar advantages. A braided wire has been found to offer the required durability although it is possible to use single strand wire. A synthetic cord such as Nylon would also be suitable.

Figure 7:
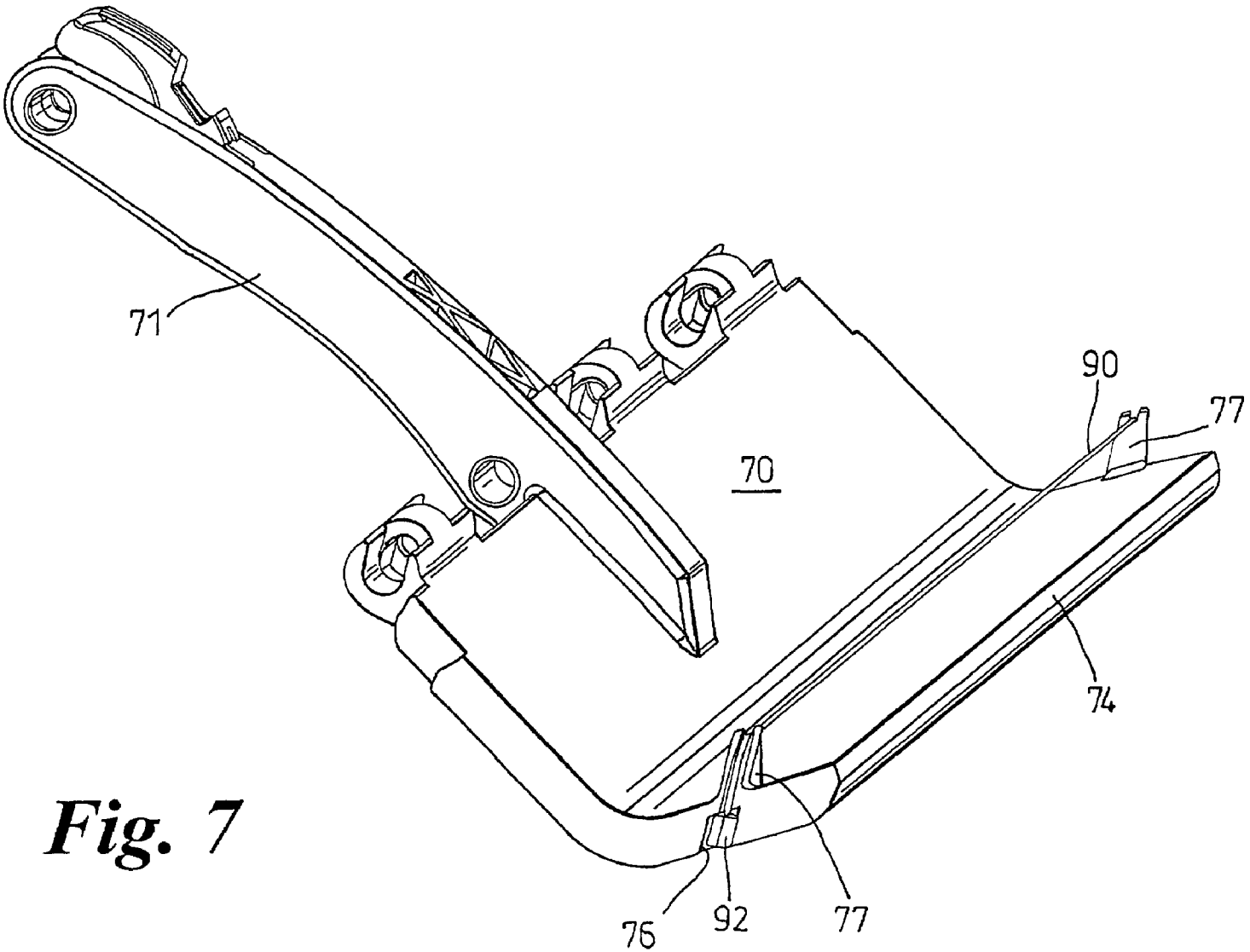
FIG. 7 shows just the dispensing plate of the dispensing apparatus of FIGS. 2 and 3.

FIG. 7 shows just the hopper plate 70 and the parts which fit to the plate. A ferrule 92 is crimped to each end of a length of wire 90. The ferrule 92 is retained in a recess 76 on each side of the hopper plate 70. The wire 90 is spaced from the surface of the plate 70 by supports 77 which extend outwardly from the plate 70 into the chamber 60. The outer surface of each support is grooved so as to retain the wire 90 in position. The wire 90 is of such a length that it is retained under tension between the supports 77. This ensures that the wire is taut at all times, which improves the cutting action of the wire 90 on the cleaning powder.

Figure 8:
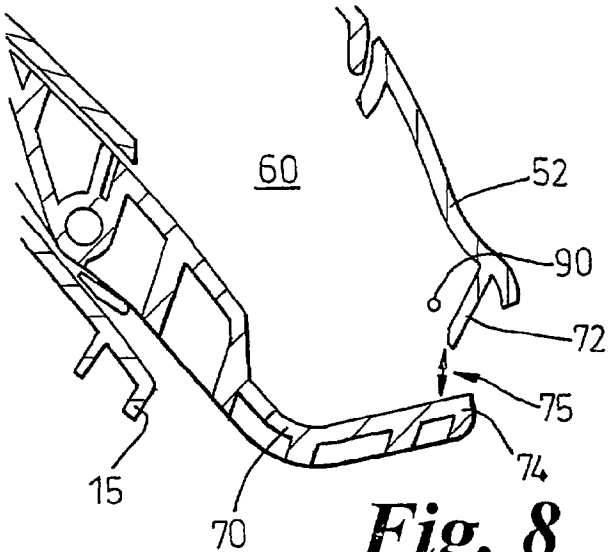
FIG. 8 shows an alternative position for the separating means.

While the wire has been found to be particularly effective when it is carried by the plate 70, it could alternatively be attached to each side of the housing 52 near to the flange 72, as shown in FIG. 8. In this alternative embodiment, any clumps of powder on the plate 70 are moved upwardly towards the wire where they are separated by the fixed wire. While a single wire 80 is shown in the Figures, it is possible to use two or more wires which are spaced apart perpendicularly from the surface of plate 70 or laterally along the plate 70.

Figure 10:
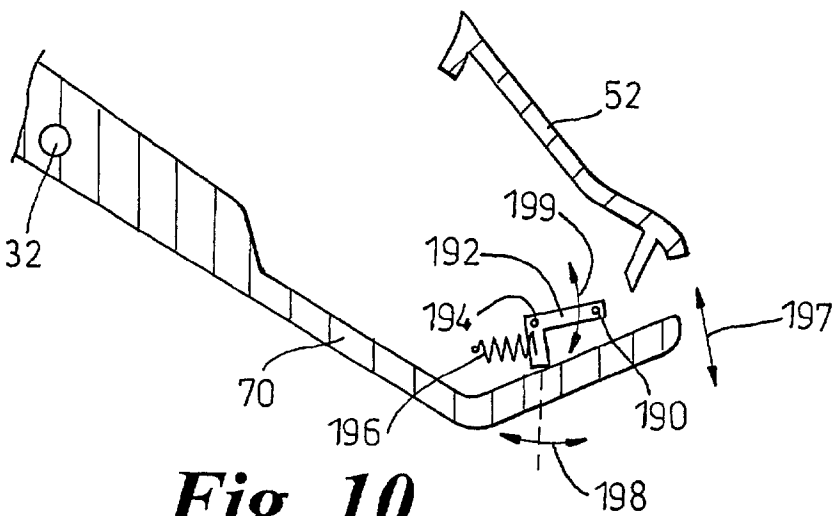

A further alternative to the fixed wire is shown in FIG. 10. An L-shaped part 192 is pivotably mounted to each side of the hopper housing 52. A wire 190 is secured to each of the parts 192. One of the arms of parts 192 is biased by spring 196 so that it rests against the surface of hopper plate 70. Movement of the hopper plate 70, shown as 197, causes the parts 192 to move in the manner shown by arrow 198, which in turn causes the wire 190 to move in the manner shown by arrow 199. Thus, movement of the hopper plate 70 causes wire 190 to perform a cutting action. By appropriate selection of the lengths of the two L-shaped arms of part 192, a levering advantage is gained, such that a small movement of the hopper plate 70 is converted into a larger movement of wire 190. The arm which contacts the plate 70 is shorter than the arm which carries the wire 190. As an alternative to using a wire, a cord, blade or some other material which provides a cutting action could be used.

The operation of the cleaner will now be described. To fill the dispenser 50, a user opens the lid 55 and pours cleaning powder into the hopper, filling chamber 60 of the hopper. The cleaner is operable in the following modes: dispense, groom and vacuum.

In dispense mode, the cleaner operates to dispense cleaning powder from the dispensing hopper 50. Dispenser 50 is fitted to the cleaner head 15. The separating apparatus 12 is removed from the main body 11 of the cleaner 10. The cleaner detects the removal of the separating apparatus 12 and turns off the suction fan (not shown). Alternative means can be used to control the cleaner to turn off the suction fan, such as by a manually operated control switch or a switch which is responsive to the position of the dispensing apparatus on the cleaner head. A user pushes the hopper 50 so that it is grasped by the clamp on the cleaner head 15. In this position, plate 70 and adjustment wheel 80 press against cam guard 30 and the cam guard 30 is pressed into an operational position against the cam 40 in the cleaning head 15. Plate 70 is moved, against the action of the spring 56, into a dispensing position in which dispensing aperture 75 is open. When operated, the cleaner head cam 40 rotates, causing plate 70 to vibrate at high speed. Typically, the plate vibrates at a rate of around 3000 rpm. Vibration of the plate 70 agitates powder in the cleaning dispenser and causes the powder to move downwardly towards dispensing aperture 75. Flange 72 at the dispensing jaw regulates the flow of powder from the dispenser. Wire 90, carried by plate 70, serves to separate the powder before it is dispensed, thus preventing clumps from being dispensed or from forming in the dispensing aperture 75. A user pushes the cleaner across the floor surface where they require cleaning and powder is dispensed from hopper 50 through aperture 75 on to the floor surface in an even and controlled manner.

In groom mode, the cleaner operates to brush the dispensed powder into the floor covering, with the brush bar in the cleaner head 15 operating at a reduced speed to achieve this grooming action. The user operates foot pedal 40 and lifts the dispenser 50 forwardly from the clamp. As soon as the dispenser is lifted, plate 70 moves under the bias of spring 56 into a position in which it closes the dispensing aperture 75. The dispenser can sit on the cleaner head 15 in this inoperable position or it can be removed. In either case, the dispensing aperture 75 remains closed. The user moves the cleaner across the region of the floor surface where powder was dispensed so as to groom the powder into the carpet. If a user finds that they have not properly covered the floor surface with cleaning powder and would like to dispense more cleaning powder, they can push the dispenser 50 into the engaged position on the cleaner head, whereby plate 70 moves to open dispensing aperture 75 and the dispenser will function.

In vacuum mode the cleaner operates in a conventional manner to draw dirty air into the cleaner via the cleaner head 15. The dispenser 50 can be used in its inoperable position or it can be removed from the cleaner, as described above for groom mode. The separation apparatus 12 is returned to an operational position on the main body 12 of the cleaner. The user moves the cleaner across the region of the floor surface where powder has been dispensed and groomed. The brush bar operates at normal speed and serves to agitate the floor covering. A combination of the agitation and the vacuum serve to draw dirty cleaning powder from the floor covering and into the cleaner 10 via the cleaning head 15. The separating apparatus 12 separates the dirty powder from the air and exhausts cleaned air to the atmosphere.

Variations will be apparent to a person skilled in the art and are intended to fall within the scope of the present invention.

What is claimed is:

1. A floor cleaning apparatus comprising a main body, a cleaner head, a dispenser on the cleaner head for dispensing particulate cleaning material onto a floor surface, the dispenser comprising a hopper for holding the particulate cleaning material, a dispensing aperture provided for and extending across the hopper through which the particulate cleaning material can be dispensed, a separator adjacent to and separate from the dispensing aperture that separates the particulate cleaning material before it is dispensed through the aperture by performing a cutting action on the particulate cleaning material, wherein a part of the hopper is movable with respect to the hopper to impart movement to particulate cleaning material in the hopper, the dispensing aperture being a gap between the movable part and the remainder of the hopper and a drive for driving the movable part in an oscillatory manner.

2. The floor cleaning apparatus according to claim 1, wherein the separator is carried by the movable part.

3. The floor cleaning apparatus according to claim 2, wherein the separator is attached to sides of the movable part.

4. The floor cleaning apparatus according to claim 1, wherein the separator is carried by the hopper.

5. The floor cleaning apparatus according to claim 4, wherein the separator is pivotably mounted to the hopper and is movable by the movable part.

6. The floor cleaning apparatus according to claim 1, 2, 3, 4 or 5, wherein the separator is located upstream of the dispensing aperture.

7. The floor cleaning apparatus according to claim 6, wherein the separator is spaced from a surface within the hopper which carries the particulate cleaning material.

8. The floor cleaning apparatus according to claim 7, wherein the separator has a longitudinal axis that is substantially parallel to the surface within the hopper which carries the particulate cleaning material.

9. A dispenser for dispensing particulate cleaning material onto a floor surface comprising a hopper for holding the particulate cleaning material, a dispensing aperture provided for and extending across the hopper through which the particulate cleaning material can be dispensed and a separator adjacent to and separate from the dispensing aperture that separates the particulate cleaning material before it is dispensed through the aperture by performing a cutting action on the particulate cleaning material, wherein the separator is a wire.

10. The dispenser according to claim 9, wherein the wire is held under tension.

11. The dispenser according to claim 9, wherein a part of the hopper is movable with respect to the hopper to impart movement to particulate cleaning material in the hopper, the dispensing aperture being a gap between the movable part and the remainder of the hopper.

12. The dispenser according to claim 11, wherein the separator is attached to sides of the movable part.

13. The dispenser according to claim 9, wherein a part of the hopper is movable with respect to the hopper to impart movement to particulate cleaning material in the hopper and the separator is pivotably mounted to the hopper and is movable by the movable part.

* * * * *